US008776699B2

(12) United States Patent
Nasseri et al.

(10) Patent No.: US 8,776,699 B2
(45) Date of Patent: Jul. 15, 2014

(54) INTERCONNECTABLE FURNITURE

(71) Applicant: MooreCo Inc., Temple, TX (US)

(72) Inventors: Abbas Nasseri, Temple, TX (US); Kristen Dixon, Temple, TX (US)

(73) Assignee: MooreCo, Inc., Temple, TX (US)

( * ) Notice: Subject to any disclaimer, the term of this patent is extended or adjusted under 35 U.S.C. 154(b) by 0 days.

(21) Appl. No.: 13/930,745

(22) Filed: Jun. 28, 2013

(65) Prior Publication Data

US 2014/0007799 A1 Jan. 9, 2014

Related U.S. Application Data

(60) Provisional application No. 61/667,592, filed on Jul. 3, 2012.

(51) Int. Cl.
*A47B 57/00* (2006.01)

(52) U.S. Cl.
USPC ..... 108/64

(58) Field of Classification Search
USPC ..... 108/59, 64–67, 69, 70, 77
See application file for complete search history.

(56) References Cited

U.S. PATENT DOCUMENTS

| | | | | |
|---|---|---|---|---|
| D177,678 | S | | 5/1956 | Hvidt et al. |
| 3,053,598 | A | | 9/1962 | Cheslow |
| 3,955,850 | A | | 5/1976 | Toso |
| D332,538 | S | * | 1/1993 | Hosoe ..... D6/482 |
| D341,507 | S | * | 11/1993 | Harvey et al. ..... D6/482 |
| 5,349,708 | A | * | 9/1994 | Lee ..... 4/638 |
| D352,408 | S | * | 11/1994 | Hosoe ..... D6/482 |
| 5,438,937 | A | * | 8/1995 | Ball et al. ..... 108/64 |
| 5,676,068 | A | | 10/1997 | Kallander |
| D409,419 | S | * | 5/1999 | Wilkinson ..... D6/486 |
| D421,535 | S | * | 3/2000 | Swensson et al. ..... D6/486 |
| 6,363,866 | B1 | | 4/2002 | Schwartz |
| 7,555,989 | B2 | | 7/2009 | Sherman |
| D646,916 | S | * | 10/2011 | Barrett et al. ..... D6/511 |

* cited by examiner

*Primary Examiner* — Matthew Ing

(74) *Attorney, Agent, or Firm* — Nath, Goldberg & Meyer; Jerald L. Meyer

(57) ABSTRACT

An interconnectable furniture having a planar surface. The planar surface includes at least two pairs of curved sides, each of the pairs includes a convex side, convex with respect to points within the planar surface, and a concave side, concave with respect to points within the planar surface. The pairs of curved sides are defined by arc lengths having a same radius R, and wherein the respective sides of the planar surface meet to form rounded corners of the planar surface. Additionally, a plurality of attachment points attached to a bottom of the planar surface and located substantially near rounded corners of the planar surface formed by the at least two pairs of curved sides, and configured for attaching a corresponding plurality of legs.

19 Claims, 7 Drawing Sheets

INTERCONNECTABLE FURNITURE

CROSS-REFERENCE TO RELATED APPLICATIONS

This application claims the benefit of the U.S. Provisional Application No. 61/667,592, filed Jul. 3, 2012, which is herein incorporated by reference as if expressly set forth in its entirety.

BACKGROUND

1. Technical Field

The present subject matter relates in general to furniture and furnishings, more particularly, to interconnectable furniture units.

2. Background

Traditional furniture is limited to the number of configurations that can be achieved due to differences in the configuration of individual pieces. Even when the pieces are configured with the same size on each side, the pieces have been limited in the number of ways they can be interconnected. Thus, a furniture with an improved interconnectable shape is desired.

SUMMARY

A non-limiting embodiment of the present subject matter includes an interconnectable furniture, comprising: a planar surface comprising: a first concave side defined by a first concave arc length with a radius R; a second concave side defined by a second concave arc length with the radius R; a first convex side defined by a first convex arc length with the radius R, the second concave side extending between the first concave side and the first convex side; and a second convex side defined by a second convex arc length having the radius R, the second convex side extending between the first concave side and the first convex side and opposite the second concave side, wherein the first and second concave sides are concave with respect to points within the planar surface and the first and second convex sides are convex with respect to the points within the planar surface, wherein the respective sides of the planar surface meet to form rounded corners of the planar surface, the planar surface further comprising: a plurality of attachment points attached to a bottom of the planar surface and located substantially near the rounded corners of the planar surface, and configured for attaching a corresponding plurality of legs.

In another non-limiting embodiment of the present subject matter includes an interconnectable furniture, comprising: a planar surface comprising: at least two pairs of curved sides, wherein each of the pairs comprise a convex side, convex with respect to points within the planar surface, and a concave side, concave with respect to points within the planar surface, wherein the pairs of curved sides are defined by arc lengths having a same radius R, and wherein the respective sides of the planar surface meet to form rounded corners of the planar surface, and a plurality of attachment points attached to a bottom of the planar surface and located substantially near rounded corners of the planar surface formed by the at least two pairs of curved sides, and configured for attaching a corresponding plurality of legs.

In another non-limiting embodiment of the present subject matter includes an interconnectable furniture, comprising: a planar surface comprising: a first pair of adjacent sides defined by concave arc lengths with a radius R, the concave arc lengths being different lengths; and a second pair of adjacent sides defined by convex arc lengths with the radius R, the convex arc lengths being the same length, wherein the concave arc lengths are concave with respect to points within the planar surface and the convex arc lengths are convex with respect to points within the planar surface, the planar surface further comprising: a plurality of attachment points attached to a bottom of the planar surface and located near rounded corners of the planar surface formed by the first and second pairs of adjacent sides, and configured for attaching a corresponding plurality of legs.

In another non-limiting embodiment of the present subject matter includes a tabletop, comprising: a planar surface comprising: a first concave side defined by a first concave arc length with a radius R; a second concave side defined by a second concave arc length with the radius R; a first convex side defined by a first convex arc length with the radius R, the second concave side extending between the first concave side and the first convex side; and a second convex side defined by a second convex arc length having the radius R, the second convex side extending between the first concave side and the first convex side and opposite the second concave side, wherein the first and second concave sides are concave with respect to points within the planar surface and the first and second convex sides are convex with respect to the points within the planar surface, wherein the respective sides of the planar surface meet to form rounded corners of the planar surface.

BRIEF DESCRIPTIONS OF DRAWINGS

Many aspects of the disclosure can be better understood with reference to the following drawings, wherein.

Figure 4A:
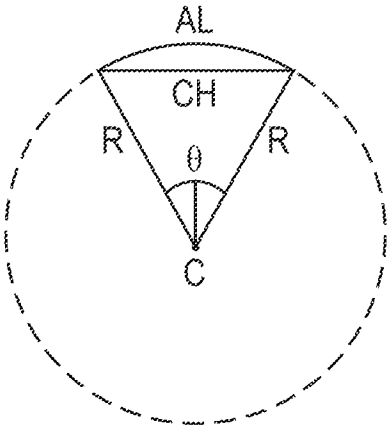
Figure 4B:
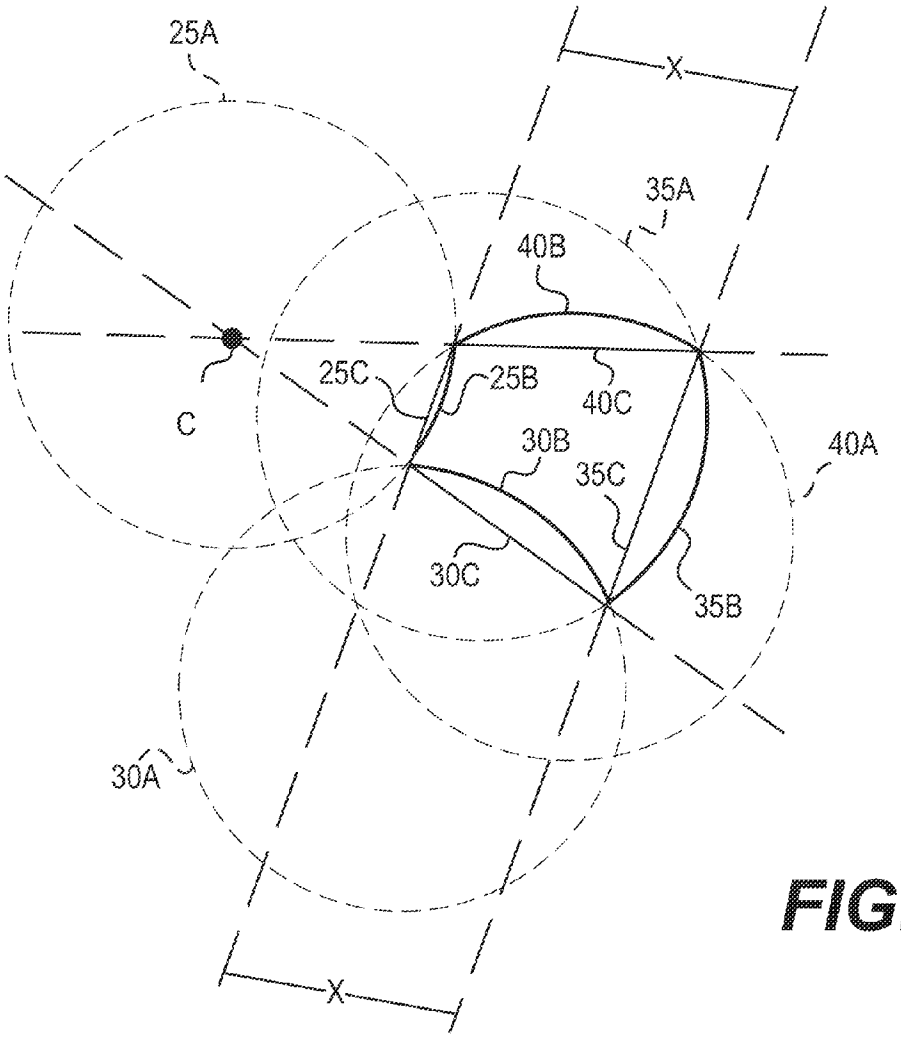
Figure 7:
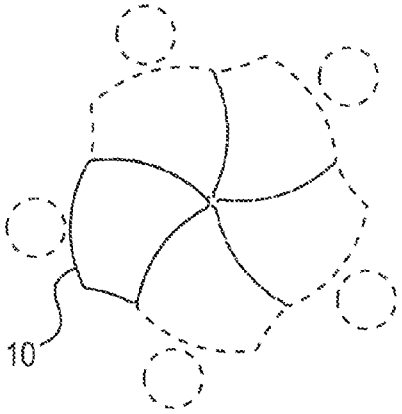
Figure 8:
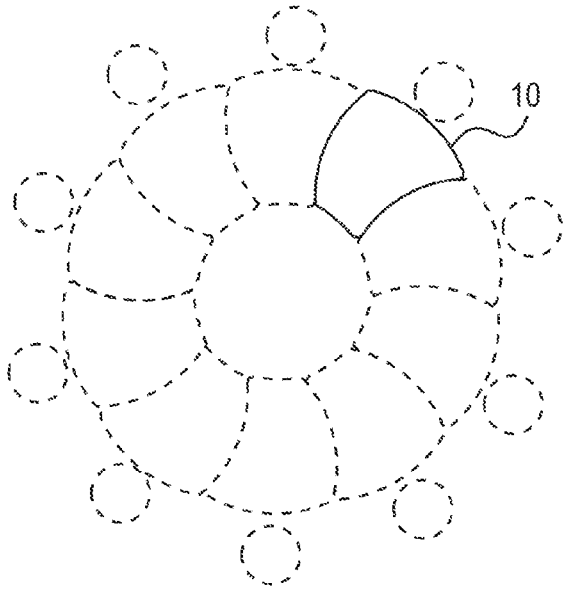
Figure 9A:
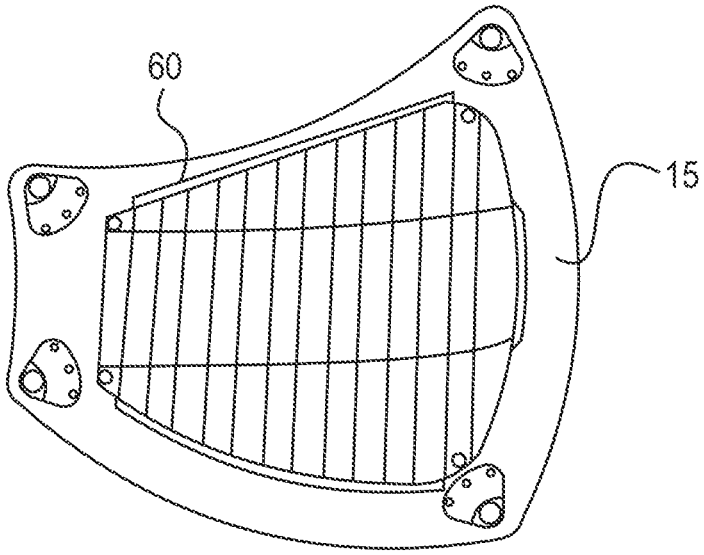
Figure 9B:
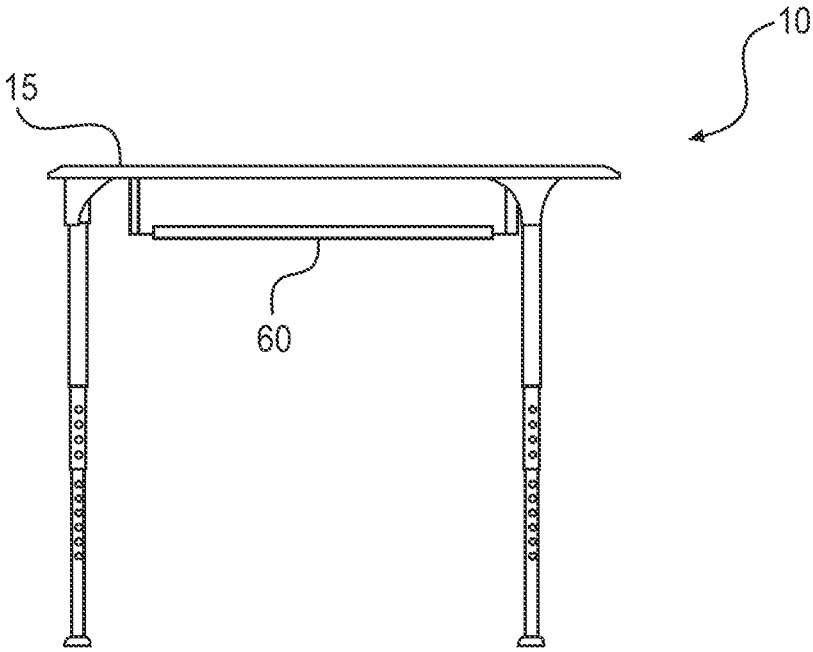

FIGS. 4A-B show the geometric relationships of the convex and concave sides of the planar surface of the interconnectable furniture;

FIGS. 5-8 show various configurations of multiple interconnectable furniture; and FIGS. 9A-B show the interconnectable furniture that includes an optional wire-frame rack.

DETAILED DESCRIPTION

Reference is now made in detail to the description of non-limiting embodiments as illustrated in the drawings. While the embodiments described may use specific materials or configurations, there is no intent to limit the subject matter to the embodiment or embodiments disclosed herein. Accordingly, various modifications to the embodiments presented may be readily apparent to those skilled in the art, and the generic principles described herein can be applied to other non-limiting embodiments without departing from the spirit or scope of the claimed subject matter. As such, this detailed description of various alternative embodiments should not be construed to limit the scope or breadth of the present apparatus, system and method as set forth in the claims.

Figure 1:
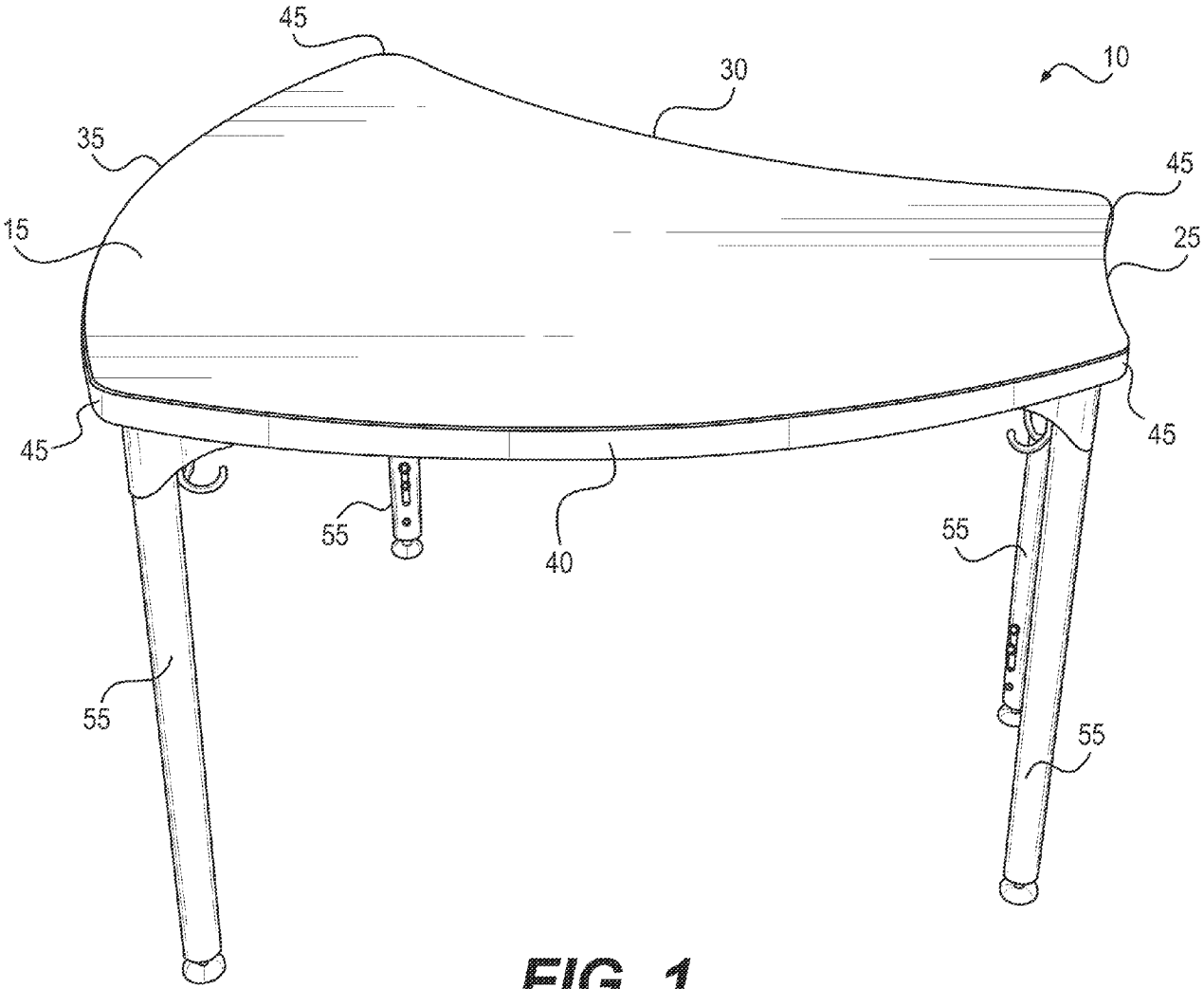
FIG. 1 is a perspective view of an exemplary embodiment of an interconnectable furniture having convex and concave sides with an identical radius R.

Shown in FIG. 1 is a perspective view of a non-limiting embodiment of an interconnectable furniture 10 having a planar surface 15 and a plurality of legs 55 attached to attachment points 50 (see e.g., FIG. 3) on a bottom side of planar surface 15. Planar surface 15 comprises a first concave side 25, a second concave side 30, a first convex side 35, and a second convex side 40. Corners of planar surface 15 formed where sides 25, 30, 35, 40 meet are rounded corners 45.

Figure 2:
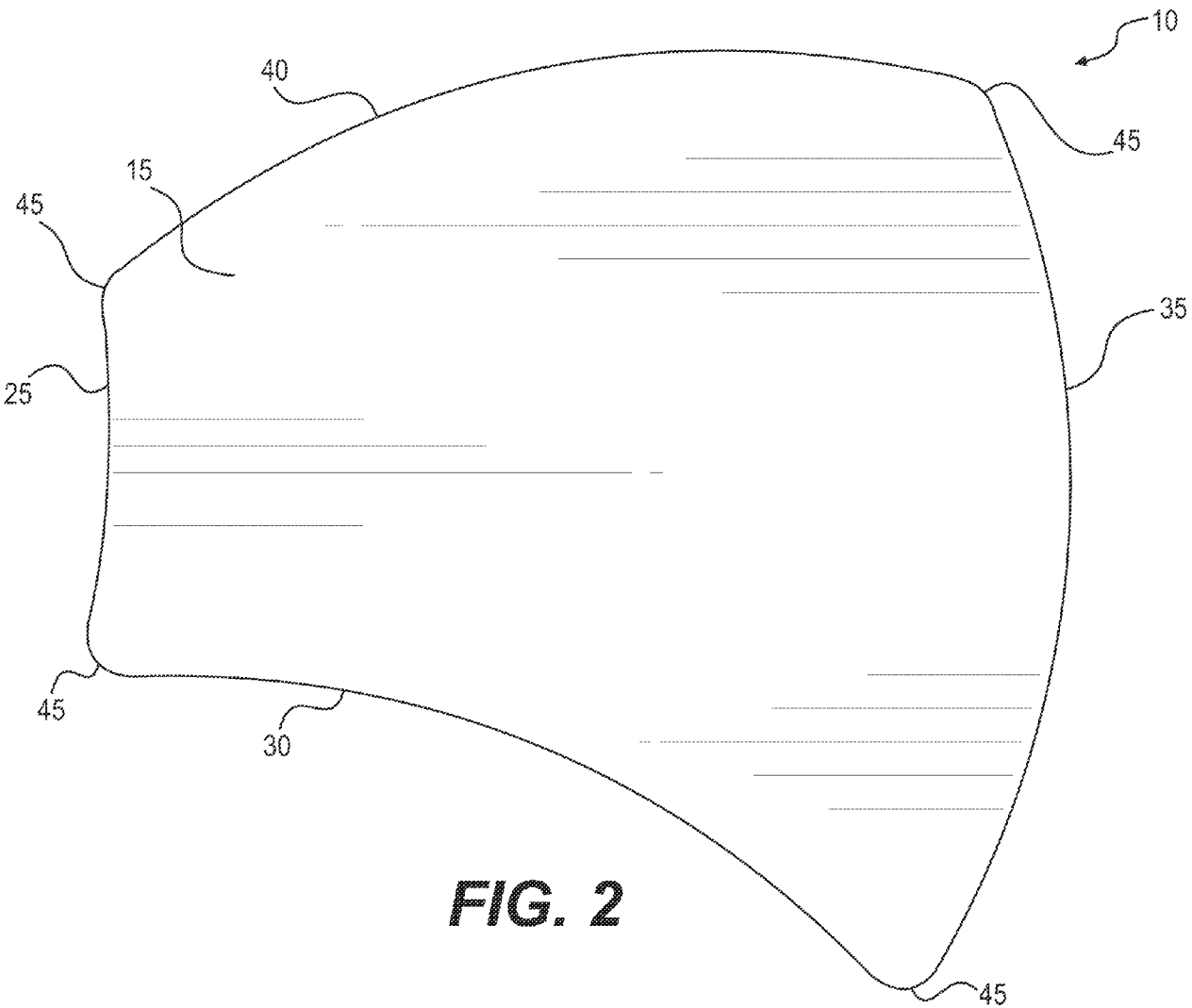
FIG. 2 is a top view of a planar surface of the interconnectable furniture.

FIG. 2 is a top view of planar surface 15 of interconnectable furniture 10, see also FIG. 4B for additional disclosure regarding a non-limiting embodiment of geometric relationships of planar surface 15. As shown in the non-limiting embodiment of FIG. 2, first concave side 25 is defined by a first concave arc length 25B (FIG. 4B) with radius R. Second concave side 30 is defined by a second concave arc length 30B (FIG. 4B) with radius R. First convex side 35 is defined by a first convex arc length 35B (FIG. 4B) with radius R, and extends between first concave side 25 and first convex side 35. Second convex side 40 is defined by a second convex arc length 40B (FIG. 4B) having radius R, and extends between first concave side 25 and first convex side 35, and is opposite second concave side 30.

In this embodiment, radius R defining each of sides 25, 30, 35, 40 and corresponding arc lengths 25B, 30B, 35B, 40B (FIG. 4B) is identical. It should be noted that identical means identical or substantially identical, such as is capable with standard manufacturing tolerances (i.e., within ⅛ inch of each other). Additionally, first and second concave sides 25, 30 are concave with respect to points within planar surface 15, and first and second convex sides 35, 45 are convex with respect to the points within planar surface 15.

Interconnectable furniture 10 can also be described as planar surface 15 comprising at least two pairs of curved sides 25, 30, 35, 40, wherein each of the pairs comprise a convex side 35 or 40, convex with respect to points within the planar surface, and a concave side 25 or 30, concave with respect to points within the planar surface. In a non-limiting example, one of the pairs in includes first concave side 25 and first convex side 35, and a second pair includes second concave side 30 and second convex side 40. The pairs of curved sides 25, 30, 35, 40 are defined by arc lengths having the same radius R and meet to form rounded corners 45 of the planar surface 15.

Additionally, interconnectable furniture 10 can also be described as planar surface comprising a first pair of adjacent sides defined by concave arc lengths with a radius R, the concave arc lengths being substantially different lengths; and a second pair of adjacent sides defined by convex arc lengths with the radius R, the convex arc lengths being the substantially the same length. For example, the first pair of adjacent sides may include first concave side 25 and second concave side 30, where first concave side 25 is shorter than second concave side 30, and the second pair of adjacent sides may include first convex side 35 and second convex side 40.

Figure 3:
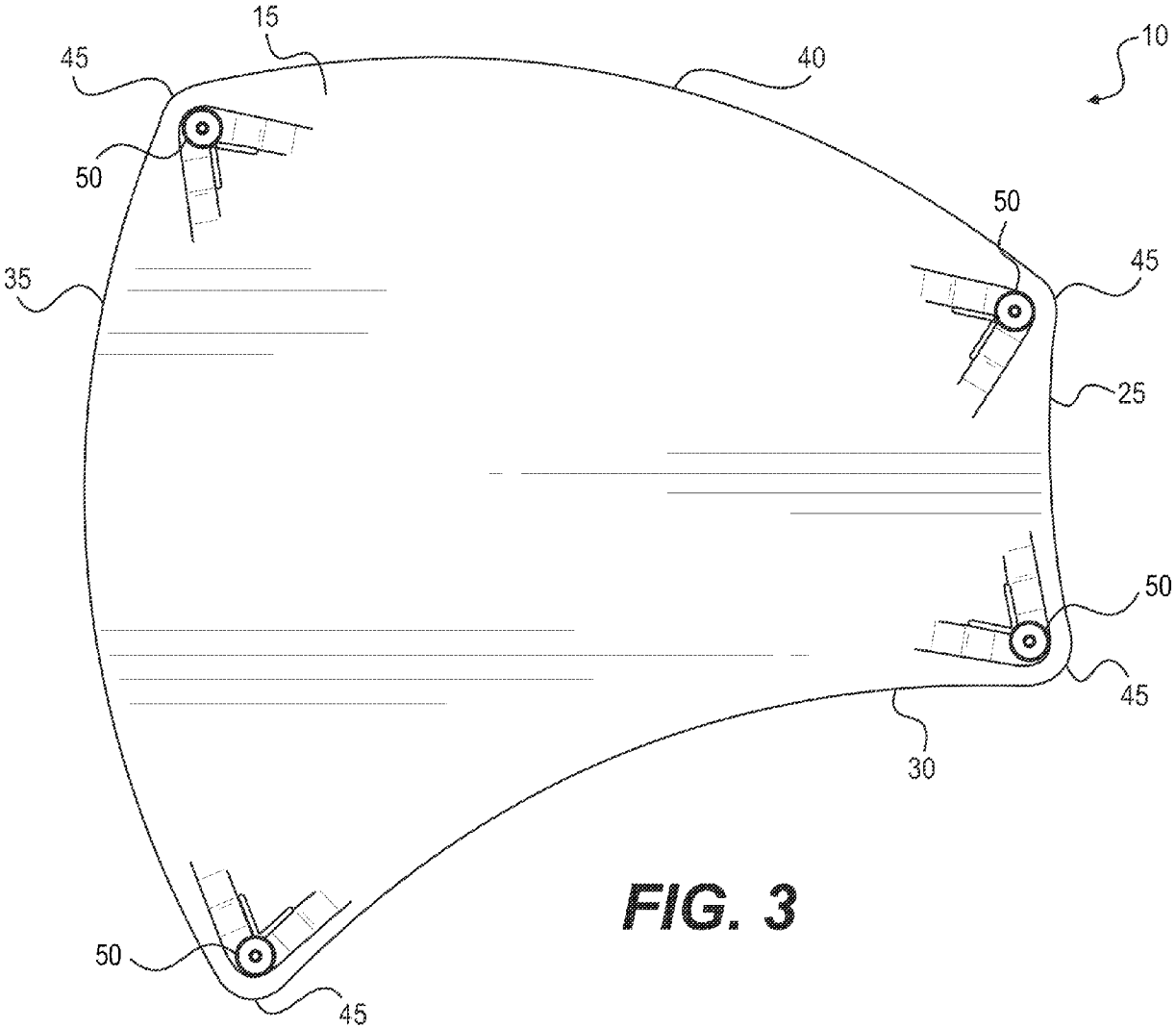
FIG. 3 is a bottom view of the planar surface of the interconnectable furniture and a plurality of attachment points.

FIG. 3 shows a bottom view of planar surface 15 of interconnectable furniture 10, further showing attachment points 50 closely adjacent rounded corners 45. Consistent with design principles and for purposes of this disclosure, "closely adjacent" means sufficiently close to rounded corners 45 as to provide maximum support and stability to interconnectable furniture 10, while taking into consideration that attachment points 45 may be inset from rounded corner 45 so as to not compromise the strength and integrity of planar surface 15. Additionally, planar surface 15 may be a tabletop without attachment points 50, thus allowing any type of table leg or legs, or elevation means to be attached to the tabletop.

In a non-limiting exemplary embodiment, planar surface 15 is a ⅝ inch to 1 and ¼ inch thick work surface comprised of a particle board core with a high-pressure laminated surface and a melamine backer sheet. Edges of planar surface 15 may further feature bumper edge molding that may be mechanically fastened to ensure a long lasting fit. The bottom side of planar surface 15 may be pre-drilled for ease of installation of, for example, attachment points 45 and/or legs 55. Additionally, as discussed above and further discussed below, curved sides of planar surface 15 are formed with an identical or substantially identical curve radius to allow several grouping options or configurations.

Attachment points 50 may be attached to the bottom of planar surface 15 via the pre-drilled holes in the bottom of planar surface 15 with screws through a steel mounting plate. In an exemplary non-limiting embodiment, attachment points 50 comprise mounting plates welded to circular steel tubes which are welded to legs 55. In another non-limiting embodiment, legs 55 are 1 and ½ inch diameter 14-gauge steel that are adjustable in height from 22 to 32 inches, in 1-inch increments. The adjustment for each leg is secured with screws. All open ends on the leg tubing can be capped with color matched plastic end caps. Further, bases of legs 55 optionally further include a leveling glide and height adjustability (22 inches to 32 inches in 1 inch increments) to allow compliance with American with Disabilities Act (ADA) requirements.

FIGS. 4A and 4B show the geometric relationships of arc lengths that define sides 25, 30, 35, 40 of planar surface 15 of interconnectable furniture 10. FIG. 4A shows geometric properties of a circle with radius R and center C. An arc length AL is shown in a solid line, which is a portion of the circumference of the circle, the remainder of which is shown as dashed line. The length of arc length AL is a function of radius R and an angle θ. A chord CH is a straight line connecting endpoints of arc length AL. The geometric relationships are further defined as: circumference=$2*\pi*R$; arc length (AL) $=2*\pi*R/\theta$; chord length $CH=2*R*\sin(\theta/2)$.

FIG. 4B shows exemplary geometric relationships of arc lengths 25B, 30B, 35B, 40B. A first concave circle 25A is shown, partially in dashed lines and a first concave arc length 25B is shown as a portion of first concave circle 25A. A first concave chord 25C is a straight line connecting endpoints of first concave arc length 25B. As discussed above, first concave arc length 25B defines the geometry of first concave side 25 of planar surface 15. In this non-limiting embodiment each circle 25A, 30A, 35B, 40B has an identical radius R, for example 36 inches.

A second concave circle 30A is shown, partially in dashed lines and a second concave arc length 30B is shown as a portion of second concave circle 30A. A second concave chord 30C is a straight line connecting endpoints of second concave arc length 30B. As discussed above, second concave arc length 30B defines the geometry of second concave side 30 of planar surface 15.

A first convex circle 35A is shown, partially in dashed lines and a first convex arc length 35B is shown as a portion of first convex circle 35A. A first convex chord 35C is a straight line connecting endpoints of first convex arc length 35B. As discussed above, first convex arc length 35B defines the geometry of first convex side 35 of planar surface 15.

A second convex circle 40A is shown, partially in dashed lines and a second convex arc length 40B is shown as a portion of second convex circle 40A. A second convex chord 40C is a straight line connecting endpoints of second convex arc length 40B. As discussed above, second convex arc length 40B defines the geometry of first convex side 40 of planar surface 15.

Additionally, in the non-limiting embodiment shown in FIG. 4B, a dimension X between extensions of first concave chord 25C and first convex chord 35C is the same or substantially the same at all points, such that the first concave chord 25C and first convex chord 35C are parallel, or substantially parallel. In this configuration, extensions of second concave chord 30C and second convex chord 40C intersect at center C of first concave circle 25A.

Points at which respective arc lengths 25B, 30B, 35B, 40B intersect form pointed corners. Accordingly, a non-limiting embodiment of planar surface 15 may comprise rounded corners 45, which are radiused or rounded to form a smooth transition between adjacent sides. In an exemplary embodiment rounded corners 45 range from ⅝ inch to 2 inch in radius. Accordingly, chords 25C, 30C, 35C, 40C may extend outside of a non-limiting embodiment planar surface 15 having a geometry as shown in FIG. 4B.

An advantage of the geometric configuration of interconnectable furniture 10 is scalability, for example, the exemplary embodiments discussed below, to effectively an infinite number of sizes. Additionally, in various embodiments, three American with Disabilities Act (ADA) compliant sitting positions are available, for example at second concave side 30, first convex side 35 and second convex side 40. For the purposes of this disclosure, an ADA compliant sitting position refers to a linear seating length, which means that a straight line of at least a desired length can be drawn within planar surface 15 and substantially adjacent to a corresponding curved side 25, 30, 35, 40.

In non-limiting embodiments, it is envisioned that each of second concave side 30, first convex side 35, and second convex side 40 provide from 18 inches to 42 inches, in ¼ inch increments, of linear seating length in various combinations. Additionally, it is envisioned that first concave side 25 provides from 11 inches to 24 inches, in ¼ inch increments, of linear seat length. The radius of arc lengths defining sides 25, 30, 35, 40 can range from 14½ inches to 50 inches, in ¼ inch increments.

In a non-limiting exemplary embodiment, second concave side 30, first convex side 35, and second convex side 40 each have a linear seating length of at least 30 inches, that is, a straight line of at least 30 inches can be drawn substantially adjacent to each corresponding side. In some embodiments, the linear seat length comprises a portion of respective chords 25C, 30C, 35C, 40C, for example, from a minimum of approximately 80% of the chord length.

In an additional non-limiting exemplary embodiment, second concave side 30 provides at least 26 and ¾ inches of linear seating length, first convex side 35 provides at least 27 and ¾ inches of linear seating length, and second convex side 40 provides at least 27 and ½ inches of linear seating length. In this non-limiting embodiment, the radius of each of side 25, 30, 35, 40 is 27 inches, within standard manufacturing tolerances.

In yet another non-limiting exemplary embodiment, second concave side 30 provides at least 33 and ¼ inches of linear seating length, first convex side 35 provides at least 34 and ¾ inches of linear seating length, and second convex side 40 provides at least 34 and ½ inches of linear seating length. In this non-limiting embodiment, the radius of each of side 25, 30, 35, 40 is 36 inches, within standard manufacturing tolerances.

The configuration of planar surface 15 of interconnectable furniture 10 is advantageous for many of the reasons. In particular, the configuration having identical radius sides 25, 30, 35, 40 allows for multiple interconnectable furniture 10 to be configured in numerous configurations. FIGS. 5-8 show several exemplary configurations of multiple interconnectable furniture 10.

Figure 5:
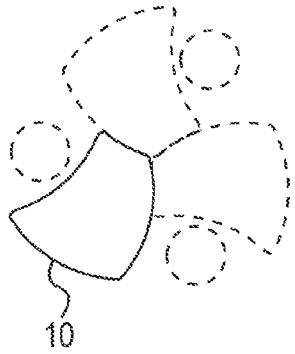

FIG. 5 shows an exemplary three interconnectable furniture 10 configuration. In this configuration, first concave side 25 of each interconnectable furniture 10 is positioned next to second convex side 40 of each neighboring interconnectable furniture 10. Due to each of the side having identical radius R, convex sides 35, 45 of planar surface 15 of interconnectable furniture 10 are able to nest within concave sides 25, 30 of neighboring interconnectable furniture 10. In the configuration of FIG. 5, seating is provided at second concave side 30 and/or first concave side 35, thus allowing left or right hand seating. Additionally, the configuration shown in FIG. 5 the three first concave sides 25 of three interconnectable furniture 10 meet at a center of the configuration.

Figure 6:
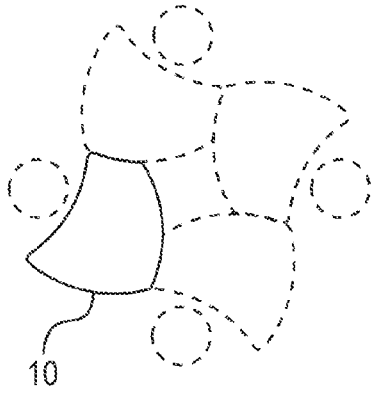

FIG. 6 shows an exemplary four interconnectable furniture 10 configuration. In this configuration, first concave side 25 of each interconnectable 10 is positioned next to second convex side 40 of each neighboring interconnectable furniture 10. Additionally, as shown, first concave side 25 is situated near rounded corner 45 between first and second convex sides 35, 40 of each neighboring interconnectable furniture 10. Accordingly, in this configuration there is an opening in the middle of the configuration. Seating in this configuration may be provided at second concave sides 30 and/or first convex sides 35.

FIG. 7 shows an exemplary five interconnectable furniture 10 configuration. In this configuration, second concave side 30 is positioned next to first convex side 35 of a neighboring interconnectable furniture 10. In this configuration, seating is provided at second convex side 40. In this configuration, second concave 30 and first convex side 35 of respective interconnectable furniture are not only of identical radius, but are also substantially the same length in order to fit within each other.

FIG. 8 shows an exemplary ten interconnectable furniture 10 configuration. In this configuration, second concave side 30 is position next to second convex side 40 of a neighboring interconnectable furniture 10. This configuration seating is provided at first convex side 35 of each interconnectable furniture. In this configuration, an outer circle is effectively formed by the ten first convex side 30 and an inner circle is effectively formed by the ten first concave sides 25.

As discussed above, multiple interconnectable furniture 10 can be oriented in various configurations, thus allowing multiple and easily-changeable configurations in classrooms, offices, or study setting, for example. As such, configurations featuring any combination of first and/or second concave sides 25, 30 positioned next to first and/or second convex sides 35, 40 are envisioned within the scope of this disclosure. Additionally, multiple interconnectable furniture 10 can be situated in series to form a line configuration, straight, curved or an arc. In such configurations, first concave side 25 would be situated against first convex side 35 of neighboring interconnectable furniture 10.

Further, in the exemplary embodiment shown in FIGS. 1-3, where first concave side 25 is shorter than first and second convex sides 35, 40, first concave side 25 can be positioned closer to or further from rounded corners 45 of first and second convex sides 35, 40 of a neighboring interconnectable furniture 10 in order to form an arc line configuration of interconnectable furniture 10, or towards the middle of first convex side 35 in order to form a straight line configuration, see also configurations shown in FIGS. 5-6, also showing first concave side 25 next of interconnectable furniture 10 is next to different portions of second convex side 40 of a neighboring interconnectable furniture 10. It is also envisioned that positions of multiple interconnectable furniture 10 could alternate, forming, for example, an alternating line configuration.

FIGS. 9A-B show interconnectable furniture 10 which includes a wire-frame rack 60 attached to the bottom of planar surface 15. As shown in this non-limiting embodiment, wire-frame rack 60 comprises a bottom with three sides defined by arc lengths having a radius R, which is smaller than radius R sides of planar surface 15 and one side that is straight, which may be where seating is intended. Wire-frame rack 60 further includes for vertical hangers which allow wire-frame rack 60 to be suspended from the bottom of planar surface 15, allowing for storage space beneath planar surface 15. Wire-frame rack 60 may be attached in a similar manner as described above with regard to attachment points 50.

The disclosure provided herein fully describes interconnectable furniture 10 in such clear and concise terms as to enable those skilled in the art to understand and practice the same, and the generic principles described herein can be applied to other embodiments without departing from the spirit or scope of this disclosure. Thus, it is to be understood that the description and drawings presented herein represent a presently preferred embodiment of the subject matter and are therefore representative of the subject matter which is broadly contemplated by the present disclosure.

The invention claimed is:

1. An interconnectable furniture, comprising:

a planar surface comprising:

a first concave side defined by a first concave arc length with a radius R;

a second concave side defined by a second concave arc length with the radius R;

a first convex side defined by a first convex arc length with the radius R, the second concave side extending between the first concave side and the first convex side; and a second convex side defined by a second convex arc length having the radius R, the second convex side extending between the first concave side and the first convex side and opposite the second concave side, wherein the first and second concave sides are concave with respect to points within the planar surface and the first and second convex sides are convex with respect to the points within the planar surface, wherein the respective sides of the planar surface meet to form rounded corners of the planar surface, the planar surface further comprising:

a plurality of attachment points attached to a bottom of the planar surface and located substantially near the rounded corners of the planar surface, and configured for attaching a corresponding plurality of legs.

2. The interconnectable furniture of claim 1, wherein at least one of the first concave side, the second concave side, the first convex side, and the second convex side has a linear seating length of 30 inches.

3. The interconnectable furniture of claim 1 wherein each of the first concave side, the second concave side, the first convex side, and the second convex side has a linear seating length of 30 inches.

4. The interconnectable furniture of claim 1, wherein the first concave side is shorter than other sides of the planar surface.

5. The interconnectable furniture according to claim 1, wherein an extension of a chord defined by the second concave arc length intersects a center of a circle that includes the first concave arc length.

6. The interconnectable furniture according to claim 1, wherein chords formed by end points of the first concave arc length and the first convex arc length are parallel.

7. The interconnectable furniture according to claim 1, wherein the radius R is at least 36 inches.

8. The interconnectable furniture according to claim 1, further comprising a wire-frame rack attached to a bottom side of the planar surface.

9. The interconnectable furniture according to claim 8, wherein the wire-frame rack comprises at least three sides defined by arc lengths with a same length radius.

10. An interconnectable furniture, comprising:

a planar surface comprising:

at least two pairs of curved sides, wherein each of the pairs comprise a convex side, convex with respect to points within the planar surface, and a concave side, concave with respect to points within the planar surface, wherein the pairs of curved sides are defined by arc lengths having a same radius R, and wherein the respective sides of the planar surface meet to form rounded corners of the planar surface, and a plurality of attachment points attached to a bottom of the planar surface and located substantially near rounded corners of the planar surface formed by the at least two pairs of curved sides, and configured for attaching a corresponding plurality of legs.

11. The interconnectable furniture according to claim 10, wherein the arc lengths of at least one of the first and second pair of curved sides are different lengths.

12. The interconnectable furniture according to claim 10, wherein one of the arc lengths of the concave sides is shorter than other sides of the planar surface.

13. The interconnectable furniture according to claim 10, wherein a linear seating length of at least one of the first and second pair of curved sides is at least 30 inches.

14. The interconnectable furniture according to claim 10, wherein the same radius R is at least 36 inches.

15. An interconnectable furniture, comprising:

a planar surface comprising:

a first pair of adjacent sides defined by concave arc lengths with a radius R, the concave arc lengths being different lengths; and a second pair of adjacent sides defined by convex arc lengths with the radius R, the convex arc lengths being the same length, wherein the concave arc lengths are concave with respect to points within the planar surface and the convex arc lengths are convex with respect to points within the planar surface, the planar surface further comprising:

a plurality of attachment points attached to a bottom of the planar surface and located near rounded corners of the planar surface formed by the first and second pairs of adjacent sides, and configured for attaching a corresponding plurality of legs.

16. The interconnectable furniture according to claim 15, wherein one of the concave arc lengths is the shortest side of the planar surface.

17. The interconnectable furniture according to claim 15, wherein the radius R is at least 36 inches.

18. The interconnectable furniture according to claim 15, wherein the second pair of adjacent sides have a linear seating length of at least 30 inches.

19. A tabletop, comprising:

a planar surface comprising:

a first concave side defined by a first concave arc length with a radius R;

a second concave side defined by a second concave arc length with the radius R;

a first convex side defined by a first convex arc length with the radius R, the second concave side extending between the first concave side and the first convex side; and a second convex side defined by a second convex arc length having the radius R, the second convex side extending between the first concave side and the first convex side and opposite the second concave side, wherein the first and second concave sides are concave with respect to points within the planar surface and the first and second convex sides are convex with respect to the points within the planar surface, wherein the respective sides of the planar surface meet to form rounded corners of the planar surface.

* * * * *